United States Patent [19]

Stern

[11] 4,214,943

[45] Jul. 29, 1980

[54] PASTER ROLLER FOR HIGH SPEED WEB HANDLING EQUIPMENT

[75] Inventor: Nathan Stern, W. Caldwell, N.J.

[73] Assignee: Bobst-Champlain, Inc., Roseland, N.J.

[21] Appl. No.: 911,360

[22] Filed: Jun. 1, 1978

Related U.S. Application Data

[62] Division of Ser. No. 661,768, Feb. 26, 1976, Pat. No. 4,151,594.

[51] Int. Cl.[2] ..... B65H 19/18

[52] U.S. Cl. ..... 156/504; 156/494; 156/582; 242/58.3; 242/75.4

[58] Field of Search ..... 156/582, 502, 504, 494; 242/58.4, 58.5, 58.3, 58.2, 75.4; 100/211

[56] References Cited

U.S. PATENT DOCUMENTS

| | | | |
|---|---|---|---|
| 2,673,168 | 3/1954 | Pascoe et al. | 156/582 |
| 2,723,931 | 11/1955 | Mercer | 156/582 |
| 3,172,613 | 3/1965 | Simons et al. | 242/58.2 |
| 3,580,757 | 5/1971 | Niepmann | 156/504 |
| 3,880,698 | 4/1975 | Kawazura et al. | 156/504 |
| 4,010,911 | 3/1977 | Heitmann | 242/58.4 |

*Primary Examiner*—Michael G. Wityshyn
*Attorney, Agent, or Firm*—James & Franklin

[57] ABSTRACT

A paster roller is provided for use on high speed web handling equipment of the type having a support upon which a feed roll and a new roll are mounted. Variable torque brakes associated with each roll exhibit a substantially constant coefficient of friction at all web speeds. Apparatus for splicing the web from the feed roll onto the web from the new roll is provided including a uniquely designed paster roller having a deflectable outer surface with annular grooves situated therein. The brakes each include a brake caliper assembly for use in conjunction with the rotatable shaft upon which the roll is mounted which has a disc member associated therewith. The assembly includes a housing having a bore therein. A port provides a fluid connection between the extension of the housing and the bore. A cylindrical puck member is at least partially received within the bore. A cylindrical piston member is movable within the bore between the port and the puck member and engageable with the latter to exact varying degrees of pressure on the puck member in accordance with the pressure of the port. The piston member has a diameter smaller than the puck member. The disc member has a surface composed of material harder than the material of which the adjacent surface of said puck is composed and having a radial pattern of grooves thereon emanating from the center thereof.

6 Claims, 13 Drawing Figures

PASTER ROLLER FOR HIGH SPEED WEB HANDLING EQUIPMENT

This application is a division of copending Application Ser. No. 661,768 filed Feb. 26, 1976 having the title of "WEB TENSION CONTROL FOR HIGH-SPEED WEB HANDLING EQUIPMENT" now U.S. Pat. No. 4,151,594 issued Apr. 24, 1979.

The present invention relates to high-speed web handling equipment and, in particular, method and apparatus for maintaining web tension during the high speed operation thereof.

Recent design improvements in printing presses have substantially increased the speed at which such equipment can operate on continuous webs of material such as newsprint and thus require the movement of the web through the press at substantially higher speeds than in the past. Because the paper upon which the printing operation is performed is quite delicate, it is subject to tearing or breaking when even relatively minor changes in web tension occur as the web is fed into the press. Tearing or breaking of the web during operation of the press requires that the press be shut down until the tear or break is repaired. Such interruptions in press operation substantially decrease the efficiency of the high-speed printing equipment.

In order to eliminate tearing or breaking of the web due to variations in web tension, different types of feed apparatus and tension control equipment have been utilized. Normally, the web feeding apparatus includes a roll stand upon which one or more material rolls are mounted. One conventional tension control system utilizes a roll stand wherein either a running or a stationary belt is maintained in contact with the surface of the expiring roll. Means are provided, such as a floating or dancer roller, to regulate the tension or wrap of the belt in accordance with web tension variations sensed by the dancer. One disadvantage of this system arises from the fact that when a new roll is being spliced onto the expiring roll, there is a period of time, approximately thirty seconds, where either the expiring roll or the new roll is under a secondary tension control system which usually provides a different tension than that provided by the running or stationary belt. The result is a side weave of the web through the printing press which often causes a web break or jam-up in the folder section of the press. A second disadvantage of this system is that the belt in contact with the roll causes linting of the paper, which on offset printing equipment results in the lint from the paper surface collecting on the blanket or printing surface and causing printing defects. Another disadvantage of this system arises from the fact that the entire tension on the roll is maintained by concentrating a high friction at the relatively small area of contact between the belt and the roll material and wrinkling of the web material often occurs.

Another conventional type of feed system which eliminates the need for stationary or running belts utilizes a brake on the center of the web core. This system also relies on tension-sensing means, often a dancer or floating roller, which is used to adjust the brake torque to provide for constant tension on the web. While this system has the advantage of eliminating the necessity for running or stationary belts, it is extremely difficult to stabilize because regulation of the torque at the center of the roll must take into account roll inertia which varies in accordance with the fourth power of the effective roll diameter, thus complicating the stability considerably. This type of system has been used with a dancer roller designed to travel through its entire excursion range as the roll expires from its maximum diameter to the minimum diameter. Thus, at the time of roll transfer, the dancer roller is required to be displaced from one extreme of its range to the other to cause the system to apply the high brake force required at the core of the new roll, a large change in brake torque as compared to the relatively small braking force required at the core of the expiring roll prior to splicing. These systems usually employ a viscous damper attached to the dancer roller to provide for the stabilization of the dancer roller. However, such damping is inconsistent with the rapid movement of the dancer roller at the time of roll transfer. Due to the above-mentioned disadvantages, neither of these conventional systems is capable of providing accurate enough tension control during web feeding and automatic splicing to permit currently available high-speed printing presses to function at peak efficiency.

Accurate tension control during web feeding is dependent upon adequate compensation for both steady state and transient web tension variations by the control system. Steady state variations in web tension are caused by variations in the inertia of the expiring roll and occur as the diameter of the feed roll is gradually reduced by the removal of web therefrom. As feed roll diameter decreases, a gradual change in the effect of the tension control system on the web is required to maintain the web tension at a constant level. Transient changes in web tension may be due to a variety of factors such as irregularities in the shape of the feed roll and must be compensated for in an efficient manner without adversely affecting the stability of the system.

In addition, accurate tension control is necessary during the automatic splicing operation, particularly at the moment when the splice takes place, in order to compensate for the substantially instantaneous change in web tension due to the change in roll inertia as the web is spliced onto a new and full-sized roll. Further, it is advantageous to achieve continuity of web tension during splicing without the necessity of extremely large dancer roll excursions at the time the splice takes place.

It is a prime object of the present invention to provide a tension-control system for use on high-speed web handling equipment which permits the use of higher web speeds without danger of web breakage or misalignment, particularly but not exclusively at the time of splicing from one web roll to another.

It is another prime object of the present invention to provide a tension-control system for use on high-speed web handling equipment which compensates more readily for steady state and/or transient web tension variations.

It is a further prime object of the present invention to provide such a tension-control system which utilizes a central core variable torque brake so designed as to facilitate the attainment of superior web tension control.

It is another object of the present invention to provide such a tension-control system wherein the brake torque setting is varied in accordance with the effective diameter of the feed roll which is determined electronically without the necessity for any external measuring devices.

It is an additional object of the present invention to provide such a tension-control system wherein the effective diameter of the feed roll is determined by generating a torque regulating signal dependent upon the initial diameter of the roll, generating an error signal in accordance with the displacement of the dancer roller from a predetermined position, and combining the two signals in such a way as to attain improved tension control.

It is yet another object of the present invention to provide such a tension-control system wherein the dancer roller is maintained in a substantially constant position as the diameter of the feed roll varies.

It is a still further object of the present invention to provide such a tension-control system wherein transient variations in web tension are compensated for by sensing the displacement of the dancer roller from a preselected position, and producing an exceptionally effective brake torque regulating signal therefrom.

It is an object of the present invention to provide such a tension-control system wherein the torque of the brake associated with a new roll is precharged to a predetermined level at the time of splicing so as to maintain continuity of web tension without the necessity of movement of the dancer roller.

It is also an object of the present invention to provide a method of splicing wherein a uniquely designed paster roller is caused to rotate at web speed at the time of the splice.

It is an additional object of the present invention to provide such a tension-control system wherein the paster roller is positioned to steady the web and prevent flutter during splicing.

It is a further object of the present invention to provide such a web tension-control system wherein a digital speed matching technique is utilized in regulating the rotation of the new roll as it is driven during the splicing operation.

It is another object of the present invention to provide such a web tension-control system wherein the tail of the cut web is a constant length regardless of web speed.

It is still another object of the present invention to provide such a web tension-control system which permits emergency braking without tearing or breaking of the web.

In accordance with the present invention, a method of web tension control in high-speed web handling equipment is provided. The high-speed web handling equipment is of the type having a core support upon which the core of a web feed roll is rotatably mounted. A variable torque brake is associated with the core and exhibits a substantially constant coefficient of friction at all speeds of the web due to the unique design thereof. A dancer roller is positioned to engage the web and is movable thereby in accordance with the variations in the web tension. The method comprises the steps of determining the initial diameter of the feed roll, setting the brake torque in accordance with the initial roll diameter and varying the brake torque setting in accordance with the variations in the effective diameter of the feed roll as the web is fed from the roll so as to compensate for steady state changes in web tension. Determination of the initial roll diameter is accomplished during press start up by applying a known force on the dancer roller and increasing the brake torque until the dancer roller is moved by the web to a preset position. At this point, the magnitude of the brake torque is sensed and a signal representative of the sensed magnitude is generated. The generated signal is divided by a signal proportional to the known applied force to obtain a resultant signal proportional to the initial diameter. As the diameter of the feed roll gradually decreases web tension will change between the expiring roll and the dancer roller, thus causing the movement of the dancer roller from the balance position. A position transducer is utilized to generate an error signal proportional to the displacement of the dancer roller. The error signal is integrated and this integrated signal is combined with the signal proportional to the initial diameter to form a signal representative of the effective roll diameter which is then utilized to vary the brake torque. Varying the brake torque causes the dancer roller to remain at the balance position as the diameter of the feed roll varies, thereby eliminating the necessity for extremely large dancer roller excursions.

Transient responses in web tension are compensated by generating a signal proportional to the displacement of the dancer roller from the balance position. A derivative of this proportional signal is obtained and combined with the proportional signal to form a correction signal capable of varying the brake torque in a manner such as to cause the surface speed of the feed roll to equal the web speed and thus maintain a constant web tension. Further, a multiple power of the signal representing the effective diameter of the feed roll is combined with the correction signal, as a result of which the transient response of the tension control system is made independent of roll diameter and thus the transient response of the system remains unaffected as the inertia of the feed roll changes.

During the splicing operation, digital speed matching is utilized to control the rotation of the new roll such that it accurately matches the speed of the expiring roll. The paster roller is positioned to steady the web to prevent the flutter thereof and is, in addition, rotatively driven up to web speed at the time of splice. As splicing takes place, the brake associated with the core of the new roll is automatically precharged to a torque level calculated in accordance with the diameter thereof such that the continuity of web tension is maintained during the splice without the necessity of dancer roller movement.

A paster roller is utilized the operative surface of which is deflectable such that a substantially planar surface region is formed at the point of contact between the paster roller and the web. This is achieved by utilizing a rubber surface of low durometer having a number of spaced annular grooves in order to permit greater surface deflection.

In addition, a unique brake design with increased tolerance between the piston and the bore, and a puck member with a diameter larger than the diameter of the piston is used to prevent binding. The disc surface is irregular and harder than the puck surface such that hardened or glazed frictional material from the puck surface is constantly removed. In this manner, material with a constant coefficient of friction is always in contact with the disc. As a result, greatly improved web tension control is achieved.

To the accomplishment of the above and to such other objects as may hereinafter appear, the present invention relates to a web tension-control system for use on high-speed web handling equipment as set forth in the annexed claims and described in the present specification taken together with the accompanying drawings wherein like numerals refer to like parts and in which:

Figures 7, 8, 14:
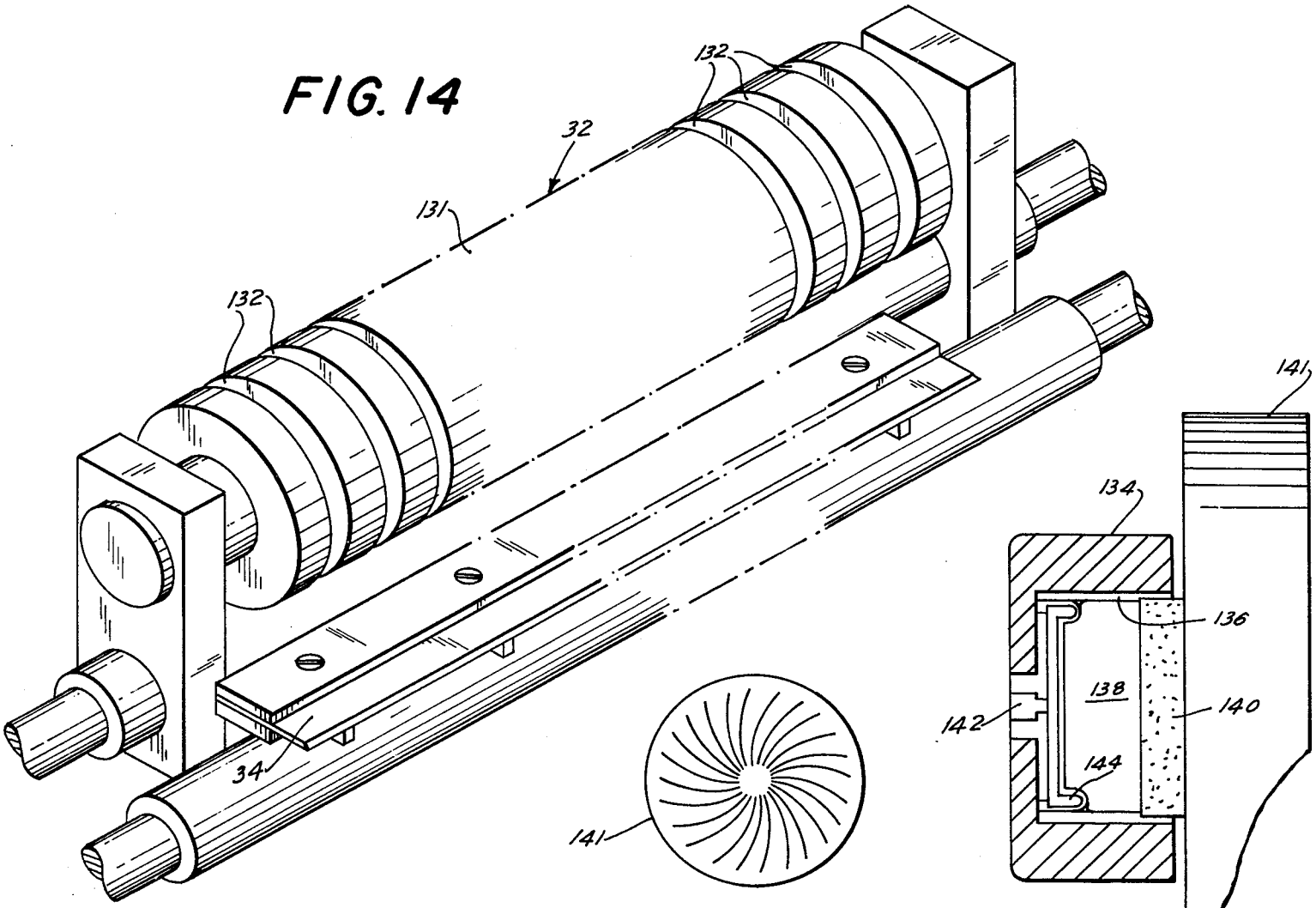
FIG. 7 is a cross-sectional view of the brake shoe assembly of the present invention.
FIG. 8 is a reduced elevational view of the surface of the disc of the brake caliper assembly.
Figure 12:
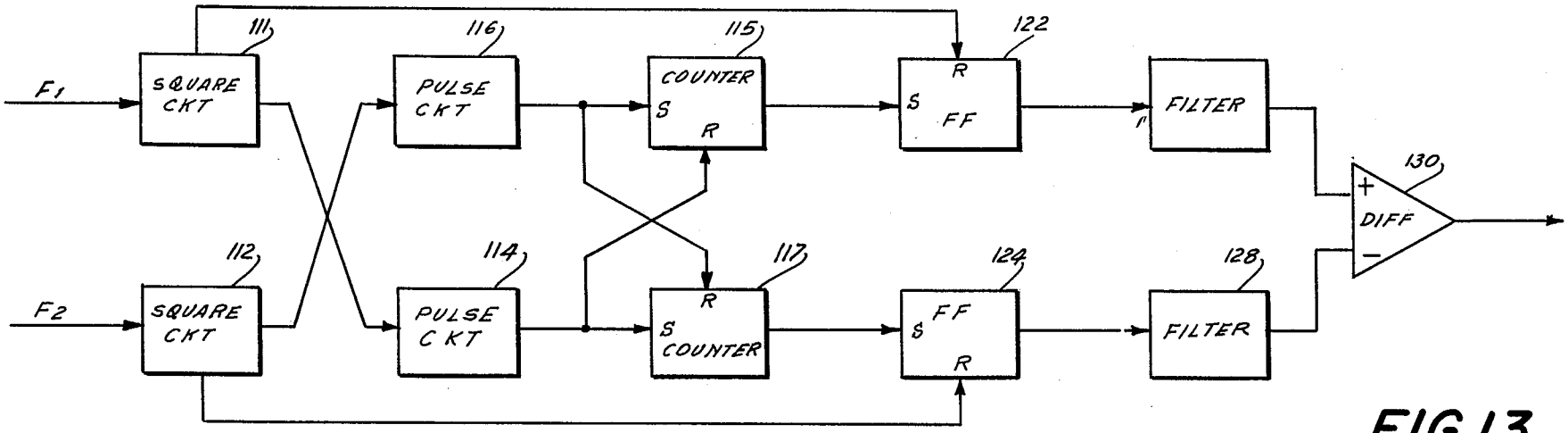
FIG. 12 is a block diagram of the digital speed matching circuitry of the present invention.

FIG. 13*a*–13*d* are a series of pulse diagrams illustrating signals generated by the components shown in FIG. 12; and FIG. 14 is an isometric view of the paster roller and knife assembly of the present invention.

Figure 1:
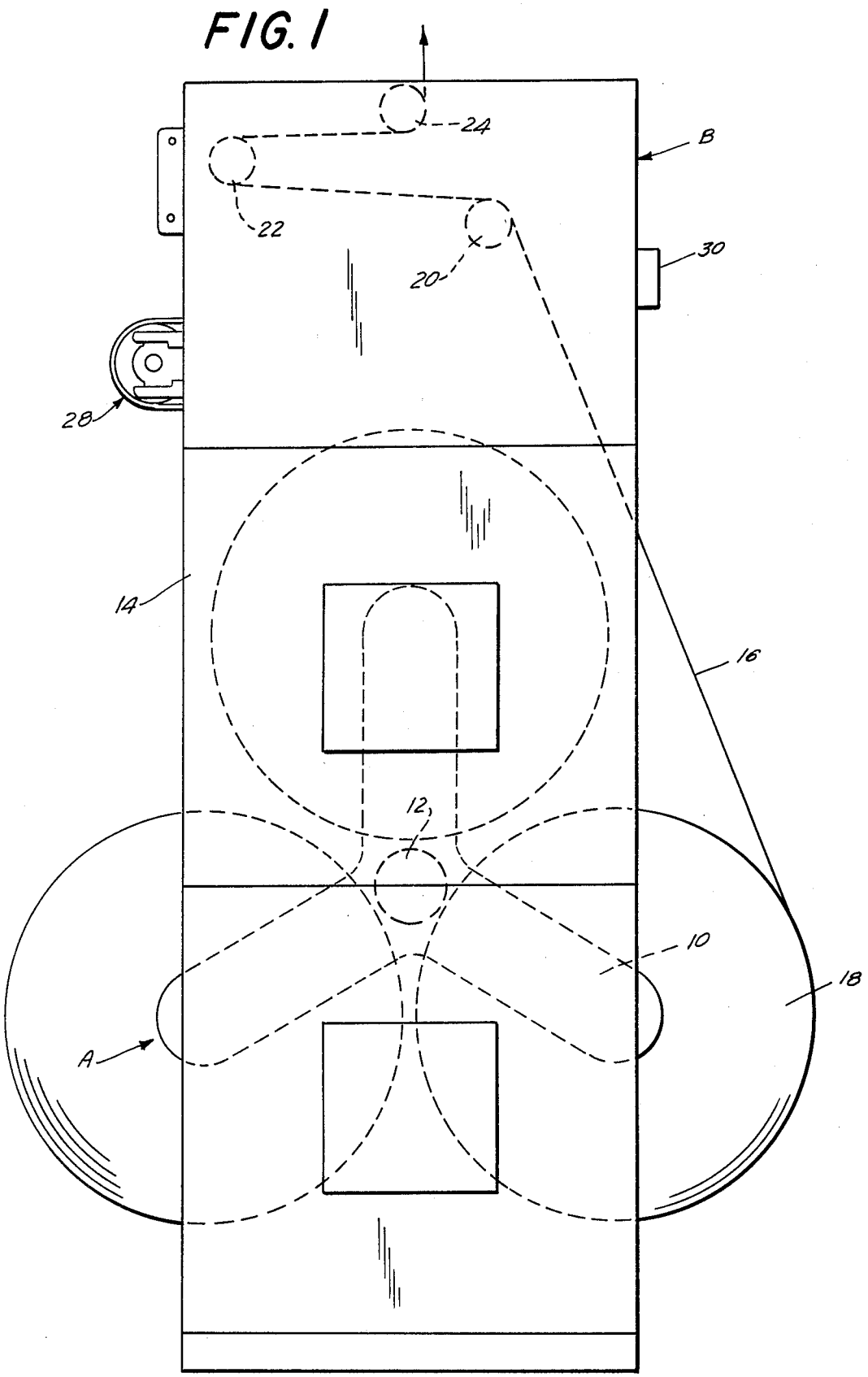
FIG. 1 is a side elevational view of the reel, tension and paster unit of the present invention.

As seen in FIG. 1, the present invention includes a free standing unit comprising two sections. One of the sections includes an indexable three-arm roll stand, generally designated A, which enables rolls of web material to be run at a constant tension with provision for roll handling capabilities, independent of press operation. The other section, generally designated B, consists of automatic pasting and predrive assemblies which permit a new roll of web material to be joined to the running web at full press speed with automatic splicing and indexing for consecutive roll changes without operator assistance.

The roll stand A consists of two spaced three-arm spiders 10 (only one of which is shown). These spider arms are mounted on a heavy main shaft 12 (called a bull shaft) which is supported by the side frames 14 of the roll stand pedestal. The lateral position for each of these spiders can be changed along the entire length of the bull shaft 12 to accommodate different rolls and running positions in the press.

The spiders support three rolls of web material, such as newsprint, for example, by ball bearing spindles (not shown) extending into the cores of the rolls from the ends and inside faces of each spider arm. Spider arms are capable of continuous circumferential rotation in either direction as well as a limited lateral movement to bring the running roll into line with the printing unit cylinders and folder. The spiders are rotatable such that movement or indexing of the rolls for loading makeup and infeeding can be readily achieved.

The web 16 from an expiring roll 18 is fed into the upper paster assembly B past a first idler roller 20, a movable dancer roller 22 and a second idler roller 24 prior to entering the high-speed printing equipment.

Figure 2:
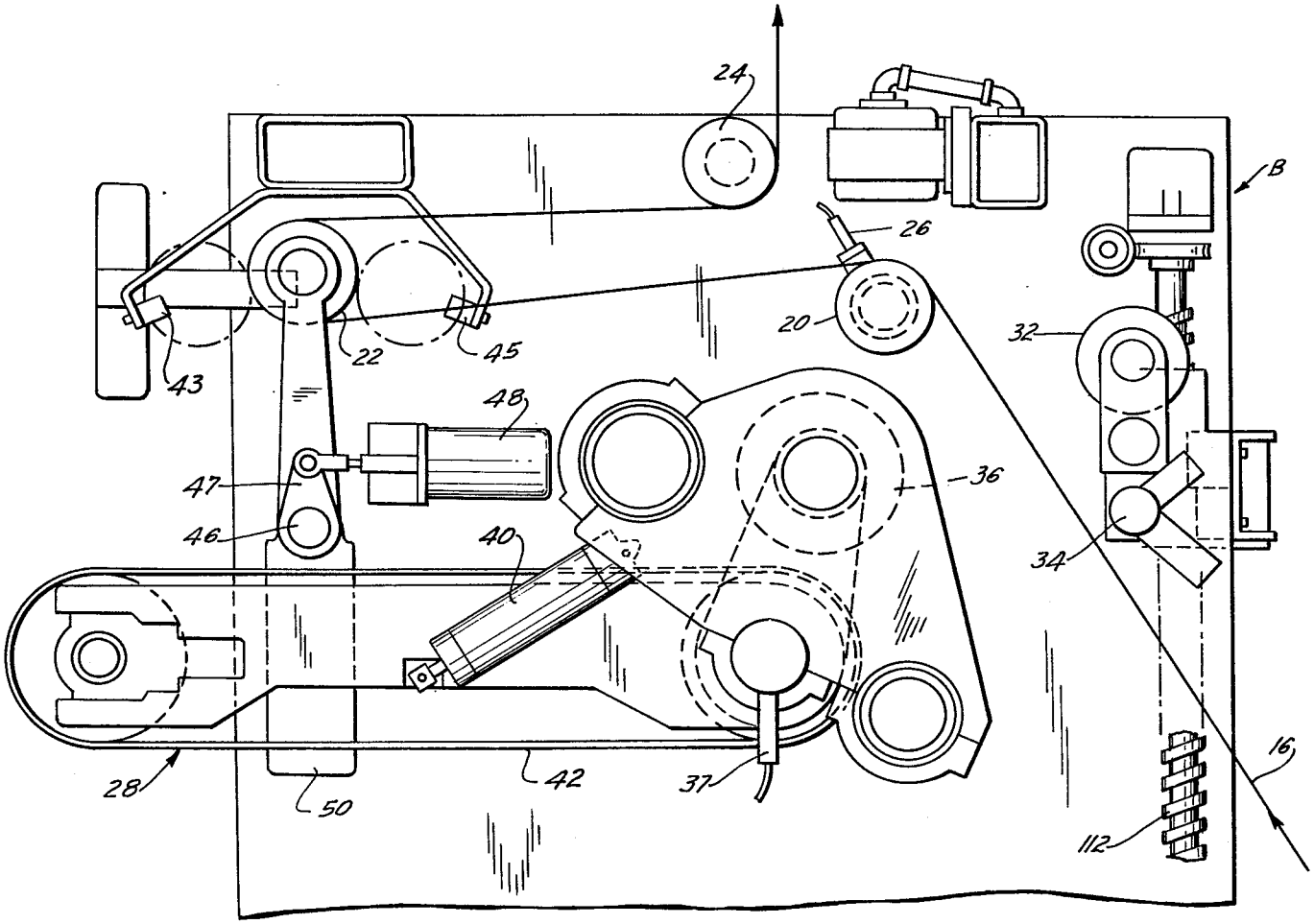
FIG. 2 is a more detailed side view of the upper paster assembly of the unit illustrated in FIG. 1.

As best seen in FIG. 2, the upper paster assembly B houses the dancer roller 22, a digitizer 26 connected to idler roller 20, a predrive assembly 28 and the paster carriage assembly 30. The predrive assembly 28, when appropriately positioned, is utilized to drive the new roll up to a surface speed equal to the web speed of the expiring roll. The paster carriage 30 serves to move the paster roller 32 and severing knives 34 into position to make the paste during the splicing operation. Two control systems, electrical and pneumatic, function together to operate the paster components during each paster cycle.

The predrive carriage 28 contains the predrive belt motor 36, roll surface digitizer 37 and solenoid valve air cylinders 40 for raising and lowering the predrive belt 42. When the predrive belt 42 is lowered, it engages the new roll to be spliced and, because the belt 42 is driven by the motor 36, drives that roll in rotation up to desired speed. The surface digitizer 37 senses the speed of the predrive belt 42 and thus of the new roll and provides a signal which is used as a reference for matching the new roll speed and the expiring web speed. As disclosed in detail herein, the signal generated by the surface digitizer 37 is compared with the signal from the web digitizer 26, which measures the speed of the expiring web, so as to provide for speed matching at the time of splicing.

Paster carriage 30 is raised and lowered by a motor (not shown) mounted to the upper paster section B. As described in detail below, the paster roller 32 contacts the web prior to splicing to steady the web and press the web against the surface of the new roll to make the paste. Pressure on the paster roller is maintained by air cylinders (not shown). The web severing knives 34 cut off the tail of the expiring web after the paste has been made. Knives 34 are also operated by means of air cylinders (not shown) which are automatically controlled so as to provide a tail of equal length regardless of the web speed.

A photoelectric system actuates the reel stand for pasting when the diameter of the feed roll is determined to be a selected value appropriate for initiation of the splicing operation. That system consists of a light source and photoelectric receiver, both of which are of conventional design. The light source is mounted on the inside of the lower casing assembly. The reflective disc is mounted on the opposite inside face of the drive side of the casing.

The dancer roller 22 is pivotally mounted to the upper paster assembly B and movable between stops 43 and 45 by means of an arm 44 connected to a rotatable shaft 46. On shaft 46 is a second arm 47 to which an air cylinder 48 is connected such that the desired load can be applied on the dancer roller 22. The effect of the dancer roller weight upon the tension level is eliminated by counterweighting the dancer roller by means of counterweight 50. The effect of counterweight 50 is particularly important at light tension levels where the dancer weight, as a function of its displacement, can otherwise contribute substantial tension errors. The dancer roller 22 is maintained as mechanically free as possible without the use of mechanical damping controls. Rolling diaphragm cylinders are used for minimum friction and dancer roller inertia is minimized for fast response.

In general, the apparatus described thus far is in the main relatively conventional insofar as function and mode of operation are concerned, and what follows sets forth the novel aspects of the present invention.

Each arm of the braking spider is provided with a variable torque brake having a shoe assembly illustrated in FIGS. 7 and 8 which acts on the core of the roll mounted thereon. Each of these brakes, as described in detail below, is uniquely designed for this function. In addition to the essential requirements of long brake life, ease of maintenance, linear response over the entire torque range and sufficient torque for emergency stop, each of the brakes is capable of exhibiting a substantially constant coefficient of friction throughout all web speeds and, in addition, can apply substantially zero torque when required.

For maximum tension control, dancer roller 22 is permitted to move within a small range without changing the torque setting of the brake. Forcing the brake control to respond to these small position changes of the dancer roller would actually excite the web and aggravate tension variations. Since maximum stability is the ultimate goal, it is necessary that the brake be relatively insensitive to small tension variations and thus permit the dancer roller to absorb the small tension variations as they occur. As explained in detail below, the control system of the present invention permits a slow brake response without sacrificing the response time for tension disturbances. This is achieved through a determination of the diameter of the expiring roll which is then utilized to directly control the brake independent of the dancer roller position so as to compensate for steady state changes in the web tension while still permitting accurate compensation for transient web tension variations.

Figure 3:
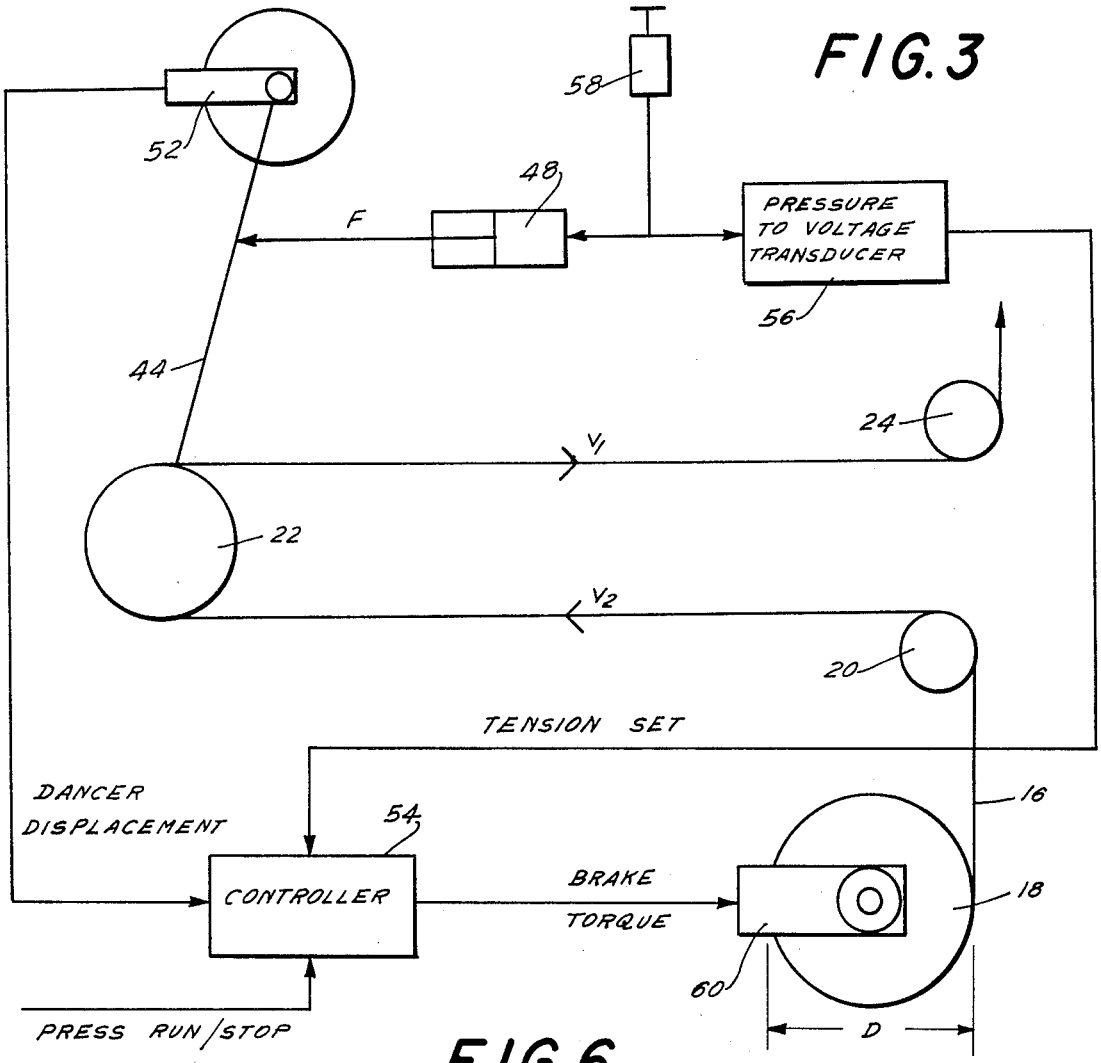
FIG. 3 is a functional diagram of the tension-control system of the present invention.

FIG. 3 shows the basic system of the present invention. Web material 16 is removed from feed roll 18, travels around idler roller 20, dancer roller 22 and idler roller 24 to the press. The position of dancer roller 22 is sensed by a position transducer 52 which generates a signal representative of the displacement of the dancer roller from a preselected position. This signal is feed to controller 54 and is indicative of the difference between the web speed and the press speed. Controller 54 also receives the output of a pressure to voltage transducer 56 which senses the force F applied on dancer roller arm 44 by load cylinder 48. Load cylinder 48 is adjusted to apply the desired force on arm 44 by means of a tension setting means 58 and pressure transducer 56 monitors this setting and generates a voltage representative thereof. The third input to controller 54 is generated by the press control system and is indicative of the running of the press.

Controller 54, in a manner set forth below in detail, generates a brake torque regulating signal (B) to brake 60 located at the core of roll 18 in order to regulate the speed thereof such that the web speed and the press speed are kept substantially equal maintaining the dancer roller at a fixed position and the web tension at the appropriate level.

Figure 4:
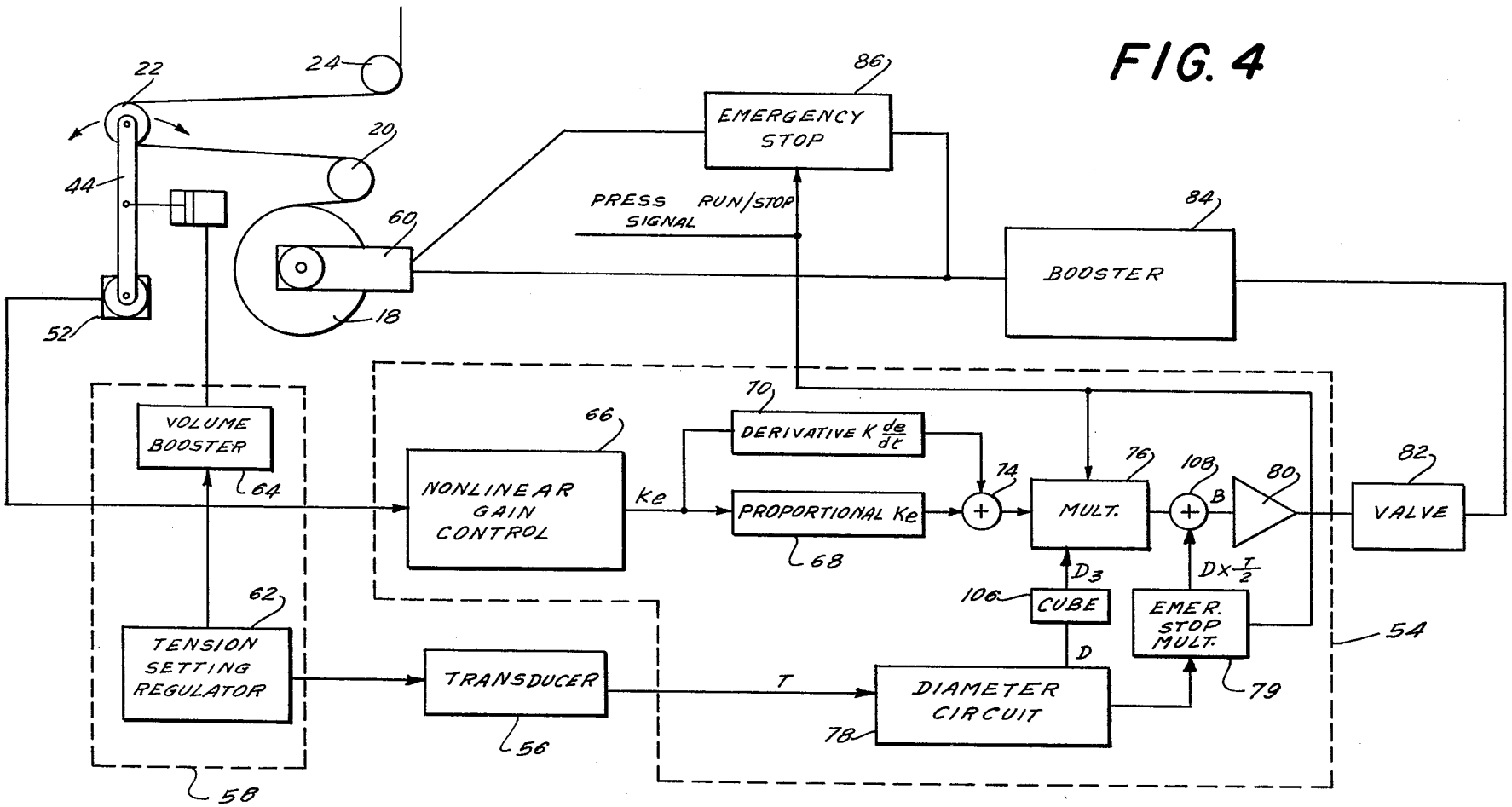
FIG. 4 is a detailed functional and schematic diagram of the tension-control system of the present invention.

The system, and particularly controller 54, is illustrated in more detail in FIG. 4. Tension setting means 58 comprises a tension setting regulator 62 which feeds a volume booster 64 such that the air pressure in load cylinder 48 is accurately set to the desired level. The setting of tension setting means 62 is sensed by transducer 56 and a signal representative thereof is feed to diameter circuit 78 and utilized to generate a signal D representative of the effective diameter of the feed roll. A non-linear gain control circuit 66 receives the output from transducer 52 and generates a non-linear signal, e, based on the displacement of dancer roller 22 from a preselected position. The non-linearity of signal e assures lower gain for small displacements and higher gain for larger displacements than would be achieved by a linear system. Signal e is fed to a proportional circuit 68 and a derivative circuit 70 wherein proportional and derivative signals, ke and $kde/_{dt}$ are respectively generated. The derivative signal reflects the rate of change of the dancer roller displacement and is utilized to control brake torque in a manner which results in an operation analogous to mechanical damping of the dancer roller movement. The proportional signal is used for stability. It provides a brake torque signal when the dancer is displaced from its preset position.

The signals ke and $kde/_{dt}$ are combined in a summation circuit 74 and then fed to a multiplier 76 which multiplies the combined signal by a signal representative of a power of the effective diameter D of feed roll 18. The signal representative of diameter D is generated by a diameter circuit 78, described in detail below. The output of multiplier 76 is fed to a summation circuit 108 wherein the signal representative of the effective steady state tension level is added to compensate for the variations in diameter of the feed roll as the web is fed therefrom. The electrical output of circuit 108 is converted to an air signal through servo amp 80 and servo valve 82 which, by means of a booster 84, regulates the air pressure to brake 60.

Also connected to brake 60 is the output of an emergency stop circuit 86 which receives the press run signal representative of the operation of the press. When the operation of the press is interrupted, it is necessary to stop the movement of the web as quickly as possible in order to prevent the tearing of the web. This is the function of emergency stop circuit 86.

Figure 5:
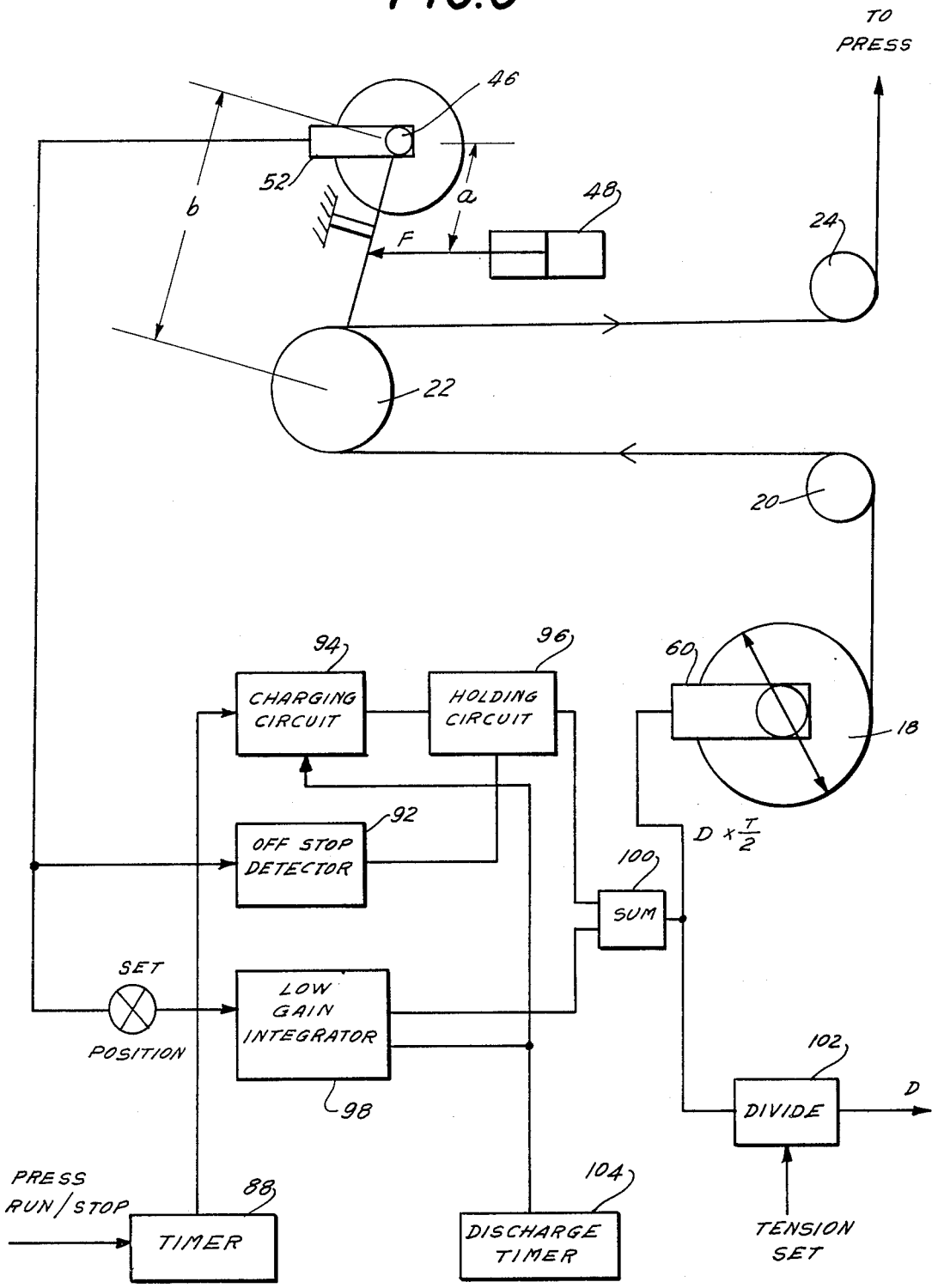
FIG. 5 is a functional diagram of the components of the present invention which permit determination of the effective diameter of the feed roll.

The steady state response of the web control system of the present invention is dependent upon an accurate determination of the effective diameter of the feed roll. The method of diameter determination is illustrated in FIG. 5 which shows the diameter circuit 78 in detail. The diameter determination utilizes a force balance system such as the dancer system illustrated or a load cell where the tension on the web is proportional to the applied external load. The external load is applied through air cylinder 48 and the counter force is applied by web 16 such that the tension T is calculated:

$$T=F/2\cdot a/b$$

when the dancer is in equilibrium or floating, wherein F equals the force applied by cylinder 48, b equals the effective length of arm 44 and a equals the distance between pivot point 46 and the point on arm 44 where force F is applied.

The diameter measurement is commenced during web start up as soon as the web begins to move. A timing circuit 88 receives the press run signal and when the press starts up, causes the torque exerted by core brake 60 to gradually increase its value from zero to the desired or set tension level by regulating a charging circuit 94. Gradual application of web tension is necessary during start up in order to avoid web breaks.

As the brake torque is gradually applied, the dancer roller will remain against mechanical stop 43 until the tension $T=F/2a/b$. At this point, the dancer will start to move off the stop 43. This displacement is sensed by a position transducer 52 of any desired type (of which many are known) connected to the dancer roller and the signal from the position transducer 52 is fed to an off-stop detector 92. Charging circuit 94, which up to this time has generated a signal to regulate the brake torque, is deactivated and the value of the charge at that time is held on the brake by means of a holding circuit 96. The value of the signal regulating the torque on the brake at this instant is:

$$B=TD/2$$

wherein T represents web tension and D represents the diameter of the feed roll.

Since the brake torque signal B and web tension T are known, the effective diameter D of the feed roll can be easily calculated. Typically, the diameter determination takes a few seconds, depending upon the set tension and the initial diameter.

The diameter of the feed roll will gradually decrease as the web expires. If the brake torque were held at a constant level as the diameter decreased, the dancer would start to move against the applied force as the tension thereon increased. As soon as the dancer moves beyond its normal running position, an error signal is generated by the position transducer 52 which is equal to the displacement of the dancer roller. The error signal is fed to a low gain integrator 98, the output of which is combined with the signal from holding circuit 96 in a summation circuit 100. Typically, the output of the low gain integrator 98 will be subtracted from the output of the holding circuit as the roll expires to reduce the applied brake torque. The resulting signal from the summation circuit 100 ($D \times T/2$) is divided by half the set tension T in a divided circuit 102 such that a signal D proportional to the effective diameter of the feed roll is produced. When the press stops, the diameter measurement circuit output is reset to zero and the pressure on the brake is released slowly by discharge timer 104 so that the dancer moves gently onto the mechanical stop.

The signal D representative of the effective diameter of the feed roll is utilized in the present invention in a unique manner to stabilize the dancer system without interfering with the inherent characteristics of the dancer roller and, thus, to permit free movement of the dancer roller in order to compensate for transient changes in web tension. Many conventional tension control systems are stabilized by "snubbing" the dancer roller with a dashpot or equivalent damping device which defeats the dancer's ability to maintain constant tension as it moves. The present invention, on the other hand, permits the dancer system to remain stable for all feed roll diameters without adversely affecting the operation of the dancer. The dancer roller movement is unrestricted such that any change in tension will immediately result in the appropriate displacement of the dancer roller.

Figure 6:
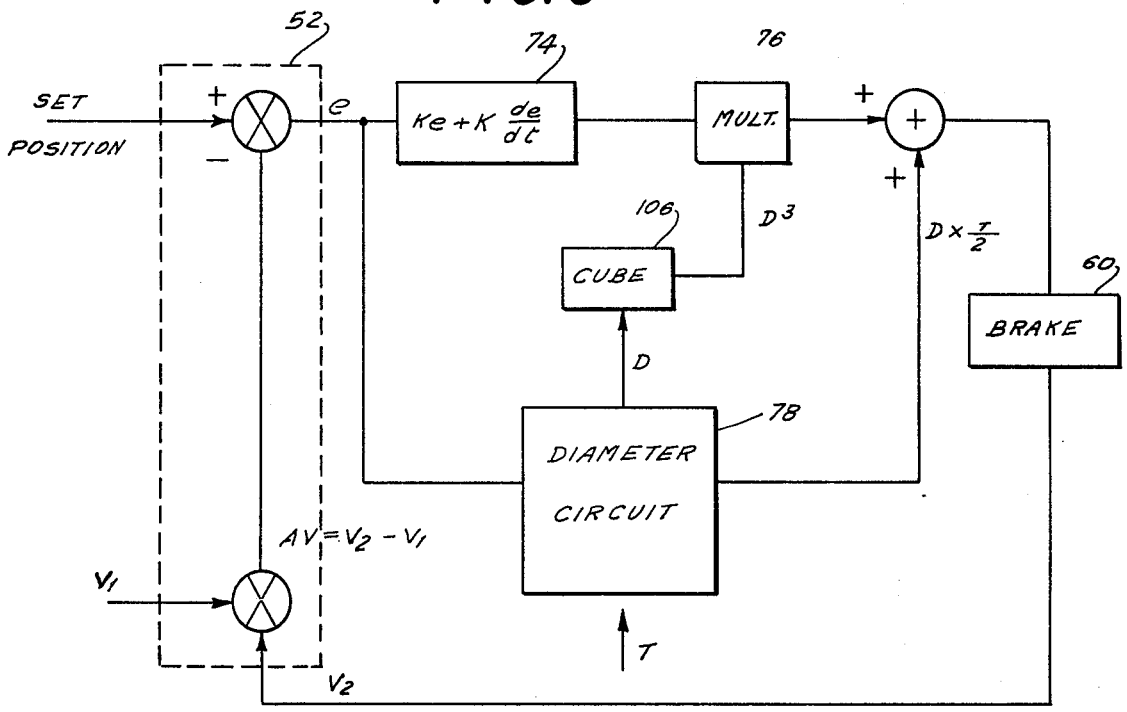
FIG. 6 is a more detailed block diagram of the tension-control system shown in FIG. 4.

Analysis of the dancer position control system is evaluated from a velocity point of view with reference to FIG. 6. For the purposes of this analysis, it is expedient to neglect the effects of dancer inertia, dancer friction, brake viscous friction and minor system lags.

In order for the tension-control system to operate effectively, it is necessary that the velocity of the expiring roll ($V_2$) be equal at all times to the press speed ($V_1$). In a conventional dancer system, operating at a fixed position without diameter compensation, an integrator is required to generate a steady state signal to the brake. If the dancer is not "snubbed", proportional and derivative controls are required for stability. However, the system gains and time constants vary by the diameter cubed ($D^3$) resulting in different transient responses for different diameters. It is this very disadvantage which the present system eliminates. Further, if an integrator is not used in a conventional dancer system, a long stroke dancer is required since the operating point of the dancer must change as a function of the diameter. However, because of the diameter compensation in the system of the present invention, the dancer roller can operate at a fixed position since the diameter circuit described above supplies a steady state control signal which is based on the effective diameter of the feed roll. The transient response for the dancer roller of the tension-control system of the present invention is made independent of diameter changes by normalizing the effect of the effective diameter in the transfer function.

As can be seen by FIG. 6, the position transducer 52 is actuated by the difference $\Delta V$ between the roll velocity $V_2$ and the press velocity $V_1$ by comparing the actual position of the dancer roller with a set position thereof and an error signal e is generated in accordance with this displacement of the dancer roller. Error signal e is processed such that a non-linear signal proportional thereto, ke, and the derivative of this proportional signal $k\,{}^{de}/dt$ are summed in summation circuit 74.

A mathematical analysis of this closed loop system reveals that the transient response of the circuit is proportional to the diameter of the feed roll cubed. The basic transfer function is difficult to stabilize because of the three poles (as would be seen in root locus plot of closed loop characteristic equation) at the origin due to the dancer, integrator and inertial load. However, the situation can be somewhat simplified if the integral $\rho$ kedt is neglected. This approximation can be rationalized on the basis that the output of the integrator is used as a vernier only and, thus, is very small compared to gains of proportional plus derivative. This reduces the number of poles at the origin to two.

However, even with this approximation, the gain variation due to the diameter cubed factor is still destabilizing in this system. In order to eliminate this destabilizing factor, the effective diameter measurement D, which is produced in the manner described in detail above in connection with FIG. 5, is cubed in a cubing circuit 106 and then, in multiplier 76, multiplied with the signal from summation circuit 74. The mathematical effect of this multiplication is to achieve a transfer function which is independent of diameter variations such that the resulting transient response of the system is the same for all diameters of the feed roll. The transient response of the velocity feedback loop with a step input of press velocity is determined by the ratio of the proportional gain to the derivative gain. Acceptable transient responses can, therefore, be achieved by selecting these variables to have a value which permits the transfer function to have a gain which demonstrates a fast rise time with overdamping.

The output of multiplier 76 is fed to a summation circuit 108, wherein the signal DxT/2 (from diameter circuit 78) representative of the effective steady state brake level is summed therewith to compensate for the steady state variations in the system due to the gradual reduction of the diameter of the feed rolls. In this manner, the position of the dancer roller remains unaffected by the changes in the diameter of the feed roll and is held at a relatively constant position as the diameter of the feed roll is gradually reduced.

The actual system response may vary somewhat from the theoretical transfer function due to second order lags and non-linearities inherent in the system. However, the same analysis applies and will result in the optimum selection of the derivatives and proportional gains. Moreover, compensation for diameter variations does not necessarily have to be restricted to diameter cubal compensation but such has been found to achieve an acceptable result. By appropriate shaping of the diameter compensation curves, a family of desired transient responses can be achieved as a function of the roll diameter. Other types of compensation techniques can also be used to achieve similar results.

It should be understood that the tension-control system of the present invention cannot function as intended unless a brake capable of accurate control of the torque applied to the feed roll at all web speeds and tensions is utilized in conjunction therewith. It is the combination of the tension-control system and the unique constructed brake which permits functioning of the system and thus, without a brake demonstrating the required characteristics, the tension-control system cannot function effectively.

FIGS. 7 and 8 illustrate the novel design of the core brake shoe assembly required for operation of the system of the present invention. The core brake utilized must achieve two functional requirements, namely: that the brake demonstrate a substantially constant effective coefficient of friction for all tension levels and press speeds; and that the brakes operate linearly at all roll speeds from standstill (i.e., zero velocity) up to 2,500 revolutions per minute. Both of these functional characteristics are absolutely essential to the proper functioning of the system of the present invention. It should be remembered that diameter calculation accuracy is directly proportional to the variation in friction in the brakes.

Typically, tension settings are varied by 8:1 and roll diameter varies by 10:1 requiring the brake torque to vary by 80:1. Additional torque is required for transients and emergency stops requiring a brake range of approximately 200:1. With air brakes operating at a maximum of 60 psi, operation at a fraction of a psi is required. In addition, the brakes must operate linearly at speeds from standstill to 2,500 revolutions per minute.

In order to achieve these requirements disc brakes using rolling diaphram seals and specially formulated brake material have been designed. The brake calipers are designed with large clearances to avoid striction due to thermal expansion and clogging due to foreign materials and brake material particulates. Dust seals are not utilized due to their adverse frictional effects. In addition, special oils are required for brake bearings to minimize viscous drag effects.

In order to ensure that the core brakes utilized exhibit a substantially constant coefficient of friction at all web speeds, a uniquely designed brake caliper assembly is utilized. Referring to FIG. 7, which shows a cross-sectional view of the brake caliper assembly utilized in the brake of the present invention, the brake caliper assembly comprises a brake caliper housing 134 having a substantially cylindrical bore 136 into which a piston member 138 and a brake puck 140 are situated. An aperture 142 provides for fluid communication from the exterior of housing 134 to bore 136 and interposed between aperture 142 and piston member 138 is a diaphragm 144 which, when the brake caliper is pneumatically actuated, causes the piston member 138 to frictionally engage the brake puck 140 and puck 140 to, in turn, frictionally engage disc 141 located adjacent the puck outside the caliper housing.

It should be noted that the brake assembly shown in FIG. 7 is provided with an unusually large clearance between bore 136 and piston member 138. Preferably, this clearance should be on the order of 0.020 inch. This unusually large clearance permits brake particle build up, dust contamination and thermal expansion without binding the assembly. Further, the large clearance permits the puck 140 to self-align to the disc 141. Without this additional clearance, disc run out will bind the brake assembly.

It should also be noted that the piston piece 138 has a smaller diameter than puck 140, thus preventing the piston piece from rubbing against bore 136. In this manner, scoring of the bore is eliminated. Since scoring of the bore will force the assembly to "stick", this structure is highly advantageous.

In addition, disc 141 is manufactured in a unique manner and the friction material utilized in the puck 140 is specially selected. Friction materials designed for a constant coefficient of friction will exhibit this characteristic only if the integrity of the surface thereof is maintained. In a continuous slipping application, such as is exhibited in a disc brake assembly, the surface characteristics of the friction material can change depending upon the slip speed, temperature and surface finish of the disc.

With a disc member having a smooth surface, the surface of the friction material can become surface hardened or form a glaze that will change its frictional characteristics. The glaze or hardening of the friction material can also damage the disc member by machining material off the surface thereof making it smoother and further aggravating the glaze problem. In order to avoid the problem of surface hardening or glaze of the friction material of the puck member 140, the friction material on the surface of the puck member 140 is constantly removed so that the inherent constant friction characteristics of the puck material are maintained. In order to accomplish this, the surface of the disc 141 is made much harder than any glaze on the friction material of the surface of the puck 140. To provide the necessary machining action, the surface of the disc is machined with a Blanchard grinder for a one hundred microinch finish (approximately) with a radial pattern emanating from the center of the surface of disc 141. This is illustrated in FIG. 8. The radial pattern provides the best machining since the finished pattern will always be substantially perpendicular to the direction of travel. The disc member is surface hardened to prevent machining of the disc surface by the frictional material of the puck 140.

Therefore, in order to provide a brake caliper assembly which exhibits a constant coefficient of friction at all speeds, a larger clearance between the piston member and the bore is provided, the diameter of the piston member is made less than the diameter of the puck member and the surface of the disc is made harder than the surface of the puck member. Further, the piston surface is machined in a radial pattern such that the friction material of the puck member is constantly removed. In this manner, the inherent constant friction characteristics of the puck material can be maintained.

Accurate tension control is particularly important during automatic splicing of the web from a new roll onto the web of the expiring roll. However, tension control is difficult during the splicing operation due to the many variables which effect tension which comes into play at the time of splicing. The system of the present invention achieves high performance during this critical period through the unique design of the paster carriage as well as the tension control system. In order to achieve the desired results during the splicing operation, it is necessary that the new roll be accurately positioned with respect to the paster carriage by the movement of the roll stand and that the acceleration of the new roll be accurately controlled. The speed of the new roll must be matched to the web speed to a high degree. In addition, the speed of the paster roller must be matched to the web speed and the impact shock of the paster roller moving the expiring web against the new roll must be minimized. Conformity of the paster roller surface to the new roll surface must be provided when the new roll surface is irregular, which is often the case. It is also desirable to sever the old web for a fixed tail independent of web speed and very important to achieve a running tension level for the new roll as soon as is feasible after the splice has taken place.

Accurate positioning of the new roll is initiated manually or automatically at a predetermined diameter. The appropriate diameter can be determined by the comparison of the output of the diameter circuit 78 which, as described in detail above, is based on the effective diameter of the expiring roll or by conventional methods. The positioning circuitry and sensing consists of a retroreflective scanner mounted such that a light beam would be broken by the outside of the roll on its center line. The outside of the roll will intercept the beam at the same position independent of roll size. The logic of positioning is such that if the beam is unbroken, the roll will advance until the beam is broken and stop. If the beam is initially interrupted, the roll will be advanced in the reverse direction such that it will back up until the beam is unbroken and then advance towards the beam until the beam is broken again and stop.

Figure 9:
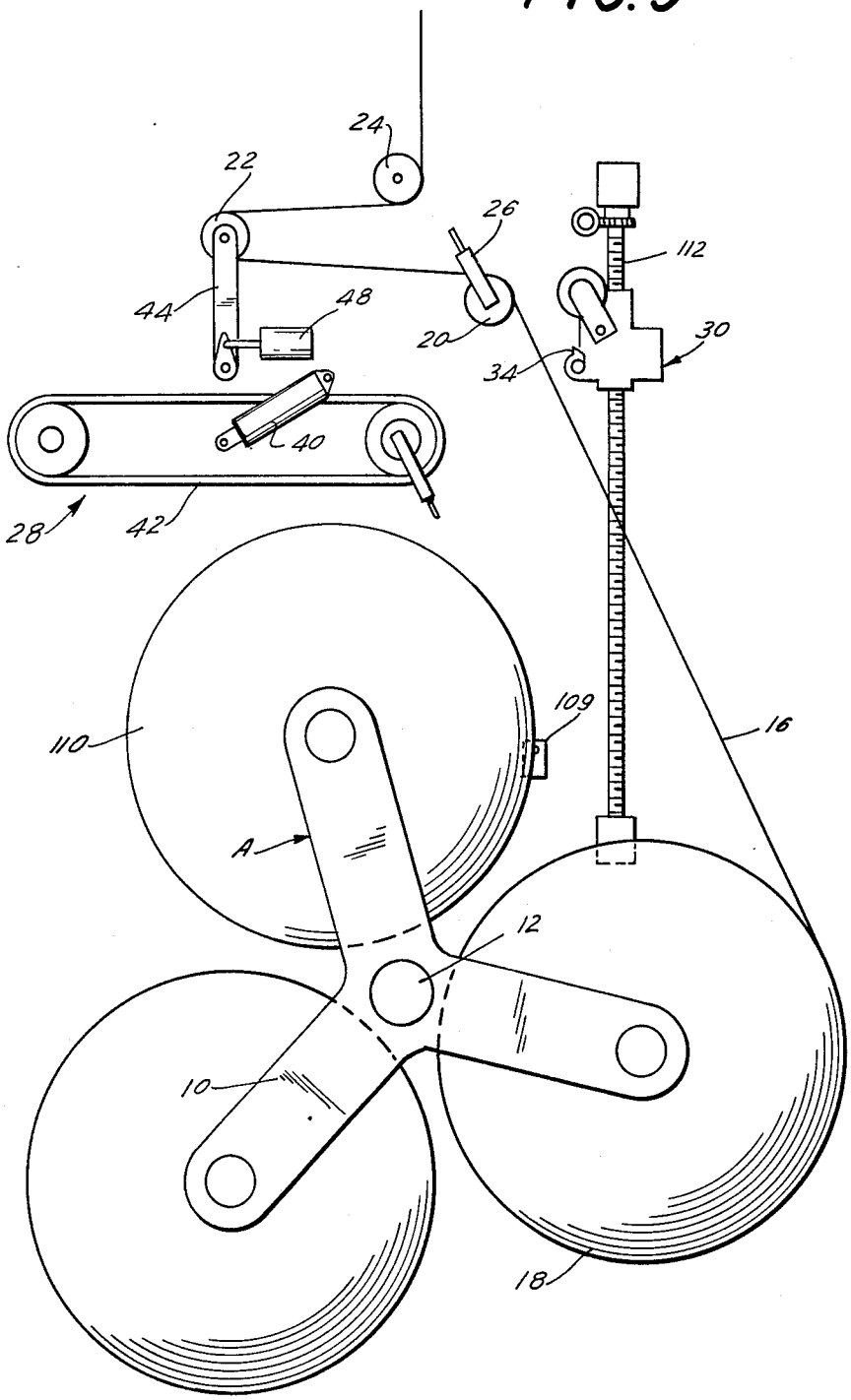
FIG. 9 is a side elevational view of the unit prior to the splicing operation.
Figure 10:
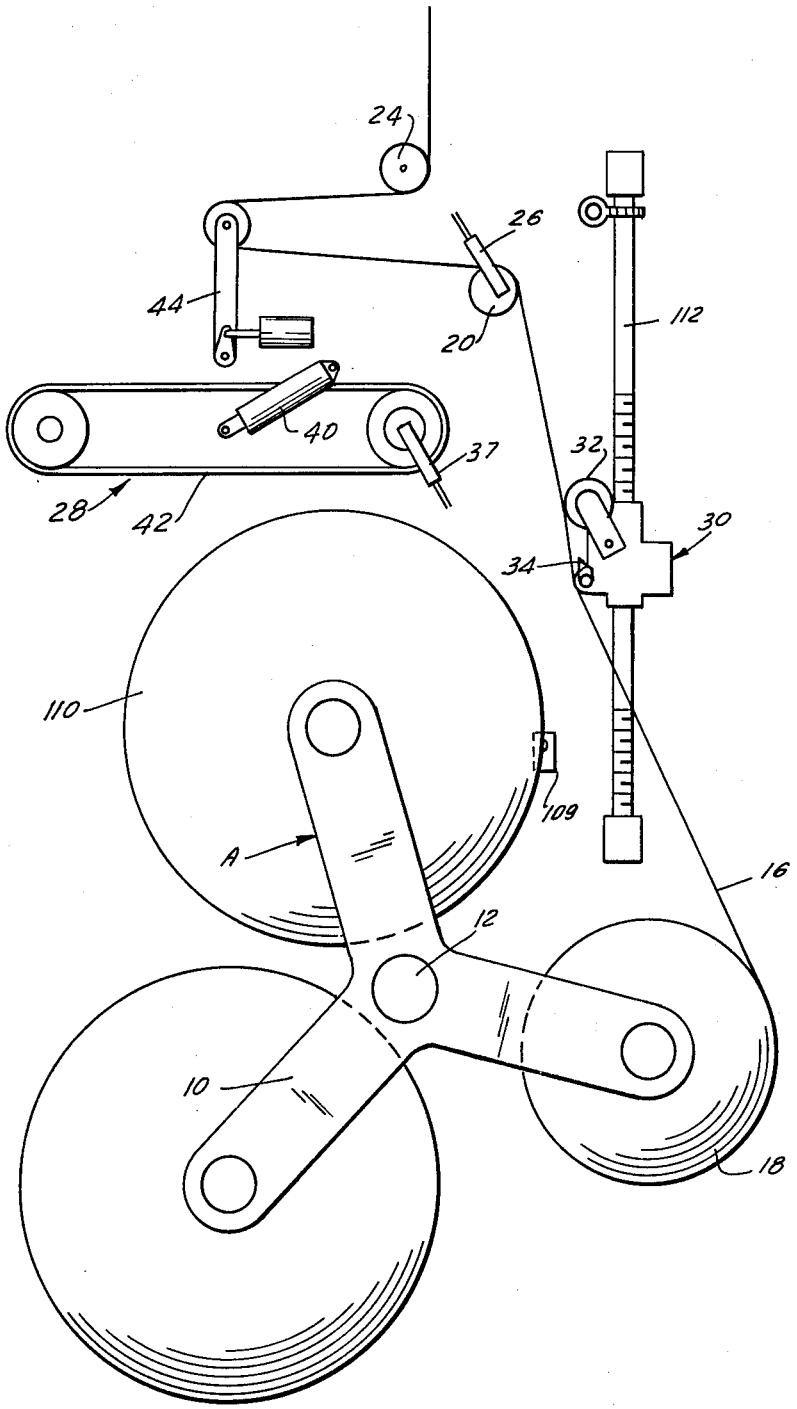
FIG. 10 is a view similar to FIG. 9, but showing the unit as the paster roller descends and engages the web.
Figure 11:
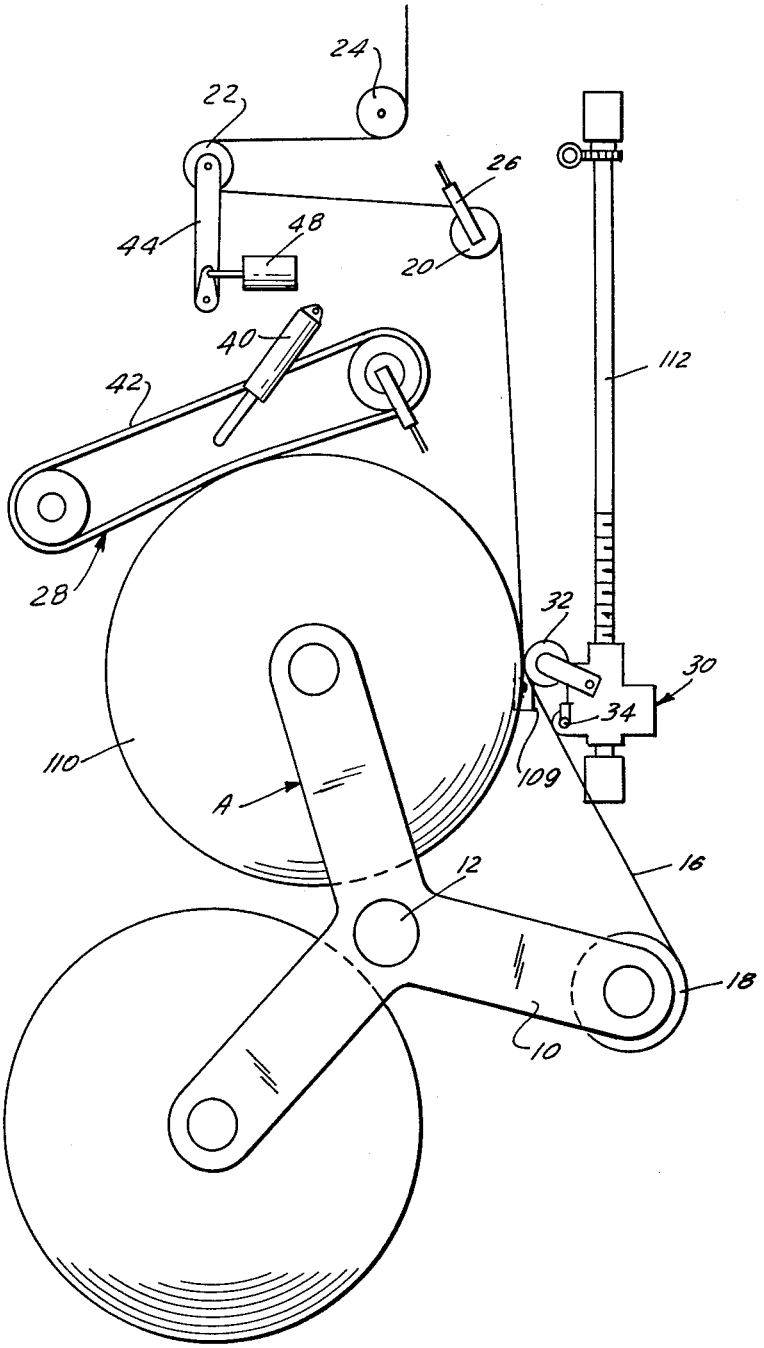
FIG. 11 is a view similar to FIG. 9, but showing the unit with the paster carriage positioned to splice.

The retroreflective scanner 109 is shown in FIGS. 9, 10 and 11 and is aligned with new roll 110. FIGS. 9, 10 and 11 illustrate, in sequence, the steps involved in the automatic splicing operation. In FIG. 9, the spider has been indexed such that new roll 110 is in the splicing position. Pasting carriage 30 is shown in its position prior to the initiation of the splicing sequence. Carriage 30 is movable relative to spider A by means of an externally threadable rotatable shaft 112 which is rotated by a motor (not shown) so as to displace the carriage. The carriage 30 contains the pasting roller 32 and knife assembly 34. In FIG. 9, the predrive assembly 28 is also shown in its position prior to the splicing operation. In FIG. 10, the automatic splicing sequence has been initiated and paster carriage 30 has been moved to an intermediate position such that paster roll 32 is in contact with web 16 from expiring roll 18.

Paper stock, such as newsprint, is relatively delicate and requires gentle handling to avoid breaks. Further, the "make ready" patterns commonly used for pasting are easily broken up if the new roll is not gently accelerated. Acceleration of the new roll is, therefore, broken up into two parts. Initially, the new roll is driven through a torque control for a "soft start". This is accomplished by limiting the maximum current of the predrive motor 36 (not shown in FIGS. 9, 10, 11). A greater torque is required to start the roll than to keep it running because of the higher breakaway friction than running friction. The "soft start" avoids the possibility of a sudden jerk in the roll which can tear the web or destroy the paster make ready pattern. After the "soft start", the roll is linearly accelerated up to the speed match velocity by predrive belt 42. Speed matching of the new roll to the expiring web is maintained to an accuracy of 0.1% through digital speed match circuitry specially designed for this purpose. The speed match circuitry is described in detail below with reference to FIGS. 12 and 13.

In addition to the speed matching of the new roll, the paster roller is also accelerated to the web velocity. This is accomplished by causing paster roller 32 to come in contact with the web 16 prior to the actual splicing, as shown in FIG. 10. The accelerating torque required from the web is minimized by the using non-contact seals in the oil bearings for the paster roller. The actual paste will occur at a predetermined diameter or manually, if desired. The logic for the paste requires speed matching of the new roll, a phase reference from the surface scanner that detects the location of the "make ready" pattern by sensing the presence of "make ready" pattern on the roll and the predetermined diameter or manual initiation. The paster roller is then actuated, as shown in FIG. 11, forcing the web from expiring roll 18 to come in contact with the new roll 110. The impact of the paster roller on the web and the new roll is minimized by the construction of the paster roller as described in detail below. The surface of this roller is made deflectable such that the expiring web will conform to the new roll at the paste.

For a given roll size, the knife 34 will sever the expiring web a fixed distance (tail) from the paste pattern, independent of press speed. This is accomplished by electronically calculating the time to fire knife 34 referenced by the retroreflective tape on the new roll. The timing is dependent upon the press speed, location of the reflective tape and actuation time. The time delay for firing the knife based on the reference position (retroreflective tape) is equal to the desired distance from the reference position to knife cutoff divided by press speed from which the actual time required for the knife to fire, once it receives the actuation signal, is substracted.

The final requirement in the paste cycle to guarantee a successful pasting operation is to establish the running tension level for the new roll 110 as soon as possible after the actual splice has taken place. This requires that the torque on the core brake for the new roll 110 be sharply increased to a value determined by the effective diameter of the new roll. This is accomplished by immediately increasing the brake torque on the brake associated with the core of new roll 110 simultaneously with knife actuation, independent of the movement of the dancer roller. The new value of brake torque is determined by resetting the value in the diameter circuit 78 (see FIG. 5) of the brake controller 54 based on a known initial diameter (within 10%) and tension, thus precharging the brake. This retains dancer roller 22 in a relatively stable position. The dancer roller will act only as a vernier to compensate for small errors relative to variations in brake torque for new roll diameter differences.

Upon completion of the paste cycle, the predrive and pasting assemblies are retracted to their normal positions (as shown in FIG. 9), and the roll is indexed to its running position, i.e., the position formerly occupied by roll 18. The third arm of the spider is utilized to store the next roll to be spliced in sequence. Thus, the system is automated so that it is possible to run off three full rolls without any manual assistance.

As indicated above, accurate speed matching of new roll 110 to the expiring web is essential to the reliable performance of the pasting operations. Slight variations in speed match as much as 0.5% can result in breakage or tearing of the web. The present invention provides a system for reliable paster operation which achieves a speed matching accuracy in the order of 0.1%. Accuracies of this magnitude require digital techniques. However, digital frequency comparators and ratio detectors normally require as many counting stages as the required accuracy. Thus, an accuracy of 0.1% would require three decades of counting stages. The present invention, however, incorporates a technique which can provide the required accuracy using only three counting stages. This system is described with reference to FIGS. 12 and 13.

FIG. 12 is a block diagram of the digital speed matching circuitry of the present invention. The system requires the use of two digitizers, one of which, designated as 26, is operably connected to idler roller 20 to provide a signal F2 representative of the web speed. The other digitizer 37 senses the speed of the predrive belt and thus of new roll 110 prior to splicing and provides a signal F1 which is representative of the speed thereof.

The outputs of the digitizers for the surface speed of the roll and the web speed are initially conditioned through separate squaring circuits 111 and 112, respectively, to provide square wave outputs. The square wave signal outputs from square wave circuit 111 and square wave circuit 112 are then fed to pulse circuits 114 and 116, respectively, wherein pulse trains are generated for the leading edges of the respective square wave signals. The outputs of pulse circuits 114 and 116, representing the two input frequencies, are then respectively used as set and reset inputs for two "count by three" counters. Each "count by three" counter will generate an output only if it receives two input set pulses after a reset pulse. This will occur at the beat frequency or difference frequency between the two input pulse trains.

Figure 13:
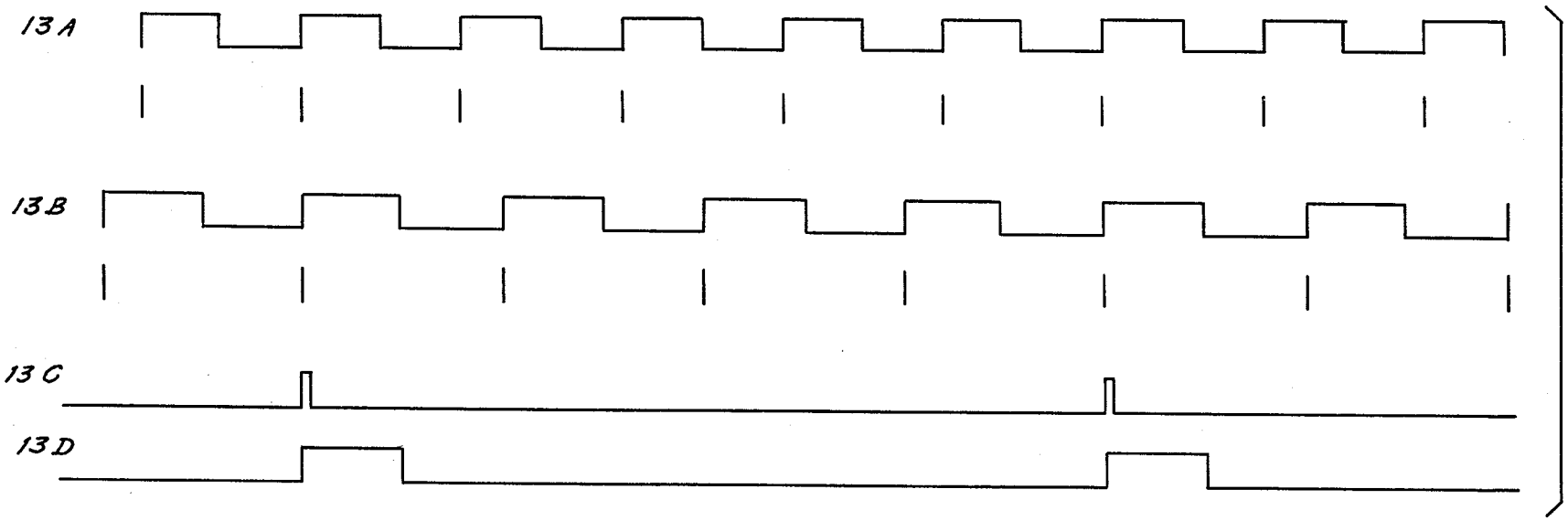

FIG. 13 demonstrates the best frequency detection for a four-to-five pulse train frequency ratio. FIG. 13A illustrates the pulse train representative of the web speed. FIG. 13B represents the pulse train representative of the new roll speed. For a given time interval, there will be five pulses in pulse train A for every four pulses of pulse train B. Each time a counter encounters two set pulses after a reset pulse, namely, when the leading edges of the pulses of pulse trains A and B coincide, a pulse is generated in pulse train 13C, which is representative of the beat frequency. The width of the beat frequency signal is amplified by using the signal to set bistable circuits 122, 124, which may consist of an RS flip-flop circuit. It should be noted that flip-flop 122 is reset from the square wave generated by circuit 111 whereas flip-flop 124 is reset with a square wave generated by circuit 112. Thus, flip-flop 122 is reset by the lower frequency F1. Using the lower frequency signal as a reset provides the maximum pulse width amplification. The higher frequency signal can be used as a reset at a sacrifice of gain for improved linearity. In the present application, the frequency ratio detector is utilized as a null device whereby gain is more advantageous then linearity. The amplified beat frequency signal, shown in 13D, is then averaged through a low pass filter 126, 128 and amplified in differential amplifier 130 to provide an analog output proportional to the difference in the two input frequencies divided by one of the input frequencies. The output of amplifier 130 will equal zero when the two frequencies are equal and will have a positive sign when one is larger than the other and a negative sign for the opposite condition. The output of amp 130 controls a D.C. motor by means of conventional circuitry to bring the roll up to the desired speed match.

FIG. 14 is a perspective view of the paster roller 32 of the present invention. As indicated above, paster roller 32 is constructed so as to minimize its impact on the web and the new roll so as to steady the web and prevent flutter thereof during the pasting operation. The paster roller is provided with a rubber surface 131 which is designed with a low spring rate by using annular grooves 132 and a low durometer (20) rubber. The roller surface is designed to compress between an eighth and a quarter of an inch to provide a flat on the order of one inch. This distributes the shock of the paster roller against the new roll. The effect of softness of the rubber covered roller cannot be controlled completely by the durometer because rubber is an incompressible substance. Deflection in rubber can only occur if it can be expanded in another direction. The annular grooves 132 in the rubber roller provide a free area for the rubber to expand, thus allowing greater deflection at the surface.

The surface of most paper rolls is somewhat irregular. It is not uncommon to have ridges and other surface variations in excess of one-eighth of an inch. If the paster roller surface was not provided with annular grooves, the expiring web would not come into complete contact with the new roll resulting in an unsuccessful paste. The annular grooves 132 in the rubber roller surface 131 allow the paster roller to conform to the surface of the new roll. Preferably, the annular grooves are approximately one-half inch wide and are situated every one and one-half inches along the surface of the roller and three-quarters of an inch deep.

As indicated above, if press operation is interrupted, the web must be stopped on an emergency stop basis in order to avoid tearing or breaking thereof. Two different approaches are available for use in emergency stopping in the present invention, depending upon the required stopping time. The closed loop emergency brake mode requires additional proportional and derivative gain which will require a higher multiplier constant in multiplier 76, thus providing a controlled stop without exceeding the limits of the dancer travel. For very high speeds and large diameters (greater than 1500 FPM and larger than 36 inch diameter), a long stroke dancer (in excess of 2 feet of storage) is required for a controlled stop. However, in most emergency stop operations, it is sufficient to stop the roll through the use of an open loop emergency stop method and allow the roll to overrun slightly. This can be achieved by defeating the closed loop gains, i.e., setting the proportional gain ke and the derivative gain k de/dt equal to zero (set multiplier 76 with constant equal to zero) and supplying a torque directly proportional to the diameter cubed through emergency stop multiplier 79. In this manner, the required amount of torque is directly related to the desired deceleration of the expiring roll. In the present invention, the closed or opened loop emergency stop modes are initiated by a press input representing emergency stop as indicated in FIG. 6.

The present invention, therefore, is a tension-control system utilized in conjunction with a specially constructed core brake for use in high speed web handling equipment. The tension-control system compensates for steady state changes in web tension due to variations in feed roll inertia such that the system response to transient tension variations is independent of changes in the feed roll diameter. The coefficient of friction of the brake is made substantially constant all web speeds and tension levels by providing brake caliper assemblies of unique design and manufacture. Speed matching of the new roll to web speed is achieved by a digital technique to assure accuracy. Tension control of a newly spliced roll is achieved simultaneously with the splice by precharging the brake to a level set by the control diameter setting. Further, a novel paster roller is utilized to stabilize the web during splicing and eliminate web flutter.

While but a single embodiment in the present invention has been disclosed herein for purposes of illustration, it is obvious that many variations and modifications can be made thereto. It is intended to cover all of these variations and modifications which fall within the scope of the present invention as set forth in the following claims.

What is claimed is:

1. A paster roller for use on high speed web handling equipment of the type having a support upon which a feed roll and a new roll are mounted, variable torque brakes associated with each roll exhibiting a substantially constant coefficient of friction at all web speeds and splicing means for splicing the web of the feed roll onto the web from the new roll, said splicing means comprising means for engaging the web from the feed roll and means for moving said engaging means to a position adjacent the periphery of the new roll to cause contact between the web from the feed roll and the web on the periphery of the new roll, said engaging means comprising a substantially cylindrical paster roller having means thereon adapted to conform to the curvature of the periphery of the new roll, said conforming means comprising a deflectable outer surface with annular grooves situated thereon.

2. The paster roller of claim 1 wherein the surface is deflectable between $\frac{1}{8}$th and $\frac{1}{4}$th inch to provide a substantially planar surface portion approximately one inch in width.

3. The paster roller of claim 1 wherein the surface has a durometer of approximately 20.

4. The paster roller of claim 1 wherein the grooves are approximately $\frac{1}{2}$ inch wide.

5. The paster roller of claim 4 wherein the grooves are situated $1\frac{1}{2}$ inches apart.

6. The paster roller of claim 1 wherein the grooves are situated $1\frac{1}{2}$ inches apart.

* * * * *